United States Patent [19]

Tanuma et al.

[11] Patent Number: 4,996,110

[45] Date of Patent: Feb. 26, 1991

[54] WHITE BOARD

[75] Inventors: Itsuo Tanuma, Sayama; Hiromi Otsuru; Toshio Honda, both of Akigawa, all of Japan

[73] Assignee: Bridgestone Corporation, Tokyo, Japan

[21] Appl. No.: 897,951

[22] Filed: Aug. 19, 1986

[30] Foreign Application Priority Data

Sep. 20, 1985 [JP] Japan ..... 60-206644

[51] Int. Cl.[5] ..... B43L 1/00

[52] U.S. Cl. ..... 428/343; 428/356; 428/480; 428/900; 434/408; 434/430

[58] Field of Search ..... 428/900, 480, 343, 356; 434/408, 409, 430

[56] References Cited

U.S. PATENT DOCUMENTS

| | | | |
|---|---|---|---|
| 3,197,326 | 7/1965 | Webber | 428/356 |
| 3,949,132 | 4/1976 | Seregely et al. | 434/408 |
| 4,427,481 | 1/1984 | Smith et al. | 428/356 |
| 4,487,586 | 12/1984 | Palmans | 434/408 |
| 4,615,930 | 10/1986 | Matsumoto et al. | 428/900 |

FOREIGN PATENT DOCUMENTS

| | | | |
|---|---|---|---|
| 668612 | 8/1963 | Canada | 428/480 |
| 6089550 | 12/1979 | Japan | 428/480 |
| 9055742 | 9/1982 | Japan | 428/480 |
| 1002556 | 1/1986 | Japan | 428/480 |
| 118774 | 6/1987 | Japan . | |
| 1316395 | 5/1973 | United Kingdom | 434/409 |

*Primary Examiner*—Paul J. Thibodeau

*Attorney, Agent, or Firm*—Sughrue, Mion, Zinn, Macpeak & Seas

[57] ABSTRACT

A white board comprises a front surface layer composed of a polyester film having undergone a hard coat treatment and a rear surface layer composed of a sheet-like magnet. The white board can be easily attached to and detached from steel walls, glass plates, etc. and stored in a rolled state when not in use.

7 Claims, 1 Drawing Sheet

WHITE BOARD

BACKGROUND OF THE INVENTION

1. Field of the Invention:

The present invention relates to a white board which is to be used instead of black boards.

2. Related Art Statement:

Most of the black boards which had been formerly used in homes and offices have been being replaced by so-called white boards having cleanliness and brightness.

Former white boards, frequently comprised enameled boards in which a vitreous material is baked onto the surface of an iron plate. Although they are preferable in terms of cleanliness and brightness, they are heavy because a base material is an iron plate. Thus, most of them are of an insertion type or of a carriable type with casters. Therefore, the former white boards are inconvenient to carry.

An example of white boards which made an improvement in this defect, is a white board using a material in which the surface of a polyester film is subjected to a hard coat treatment (polysiloxane-denaturing). The white boards of this type have been gradually adopted because they have equivalent performance as that of the enameled white boards due to high surface hardness and have excellent merit in respect of light weight. However, no special contrivance has been made with respect to the installing means.

That is, if the white board is designed as an insertion type, it has no carriable property as in the case of the white board made of iron plate. On the other hand, if it is designed as a carriable type, attachment thereof will become a problem. If the white board is mounted to a surface of a wall by means of an adhesive, it is not easy to peel and difficult to carry as in the case of the white boards of the insertion type.

SUMMARY OF THE INVENTION

It is an object of the present invention to provide a white board which eliminates the defects possessed by the above-mentioned prior art, is light in weight, carriable to an arbitrary position, and easy to install, and enables saving of installation space.

According to the present invention, there is a provision of a white board comprising a front surface layer composed of a polyester film which has undergone a hard coat treatment and a rear surface layer composed of a sheet-like magnet.

By so doing, according to the present invention, the white board can be easily installed, peeled off from an installation location, and carried to any arbitrary position.

These and other objects, features and advantages of the present invention will be well appreciated upon reading of the following description of the invention when taken in conjunction with the attached drawing with understanding that some modifications, variations, and changes of the same could be made by the skilled person in the art to which the invention pertains without departing from the spirit of the invention or the scope of claims appended hereto.

BRIEF DESCRIPTION OF THE DRAWING

For a better understanding of the invention, reference is made to the attached drawing, wherein.

DETAILED DESCRIPTION OF THE INVENTION

Figure 1:
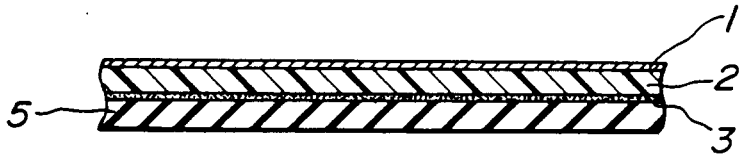
FIG. 1 is a partial side view showing a construction of an embodiment of the white board according to the present invention in which a white-colored polyester film having undergone a hard coat treatment is used as a front surface layer.

The present invention will be explained below in more detail with reference to the attached drawing.

The hard coat treated polyester film constituting the front surface layer is a polyester film which has undergone a hardening treatment such as denaturation with polysiloxane. A commercially available one may be used therefor.

As a sheet-like magnet, use may be made of commercially available rubber magnet and plastic magnet and a sheet-like article described in Japanese Pat. application Laid-open No. 60-118,774. This sheet-like article is produced by forming a magnetic pressure sensitive adhesive composed of a pressure sensitive adhesive composition and a ferromagnetic material dispersed therein into a sheet-like shape. Such a sheet-like article has a magnetic property and a pressure sensitive adhesive property in combination. These magnets have flexibility. The above magnetic pressure sensitive adhesive constituting the magnet layer used in the present invention is intended to mean that the magnetic layer can be peeled from a white board-attached surface without substantially damaging a white board-attaching interface.

Since the sheet-like magnets have flexibility and the hard coat treated polyester film constituting the front surface layer also has the flexibility, the white board according to the present invention may be stored in a rolled state when not in use. When in use, it may be stretched and attached to a surface of a wall made of steel.

In the case of the white board employing the magnetic pressure sensitive adhesive among the above-mentioned sheet-like magnets, a resisting force against a force in a shearing direction within the white board-attached surface is strong. Thus, it has the characteristic that the white boards does not move in writing. Further, since such a magnetic pressure sensitive adhesive-employing white board is easy to peel off when carrying or storing it, it best meets the object of the present invention.

Thus, the magnetic pressure sensitive adhesive composed of the adhesive composition containing the ferromagnetic material which may be used as the rear surface layer according to the present invention will be explained in greater detail below.

As the rear surface pressure sensitive adhesive composition used for this purpose, rubber base and acrylic base pressure sensitive adhesive compositions are preferred.

As the rubber base pressure sensitive adhesive composition, a pressure sensitive adhesive composed of Component A, Component B, Component C and Component D. Component A is a rubber component such as ethylene-propylene-diene terpolymer rubber, butyl rubber, conjugated diene butyl rubber, halogenated butyl rubber, natural rubber, polyisoprene rubber, block styrene-butadiene copolymer rubber, or block styrene-isoprene copolymer rubber may be used. Component B is a tackifier agent of liquid polybutene, liquid polyisobutylene, a natural resin such as rosin, rosin derivative, or terpene resin, or a synthetic resin such as petroleum resin, phenol resin, or xylene resin. Component C is an inorganic filler such as calcium carbonate, silica, clay, titanium white, zinc oxide, or carbon black. Component D is a curing agent such as a peroxide, sulfur, polyisocyanate compound. The pressure sensitive adhesive composition mainly composed of Components A+B+C is preferably used in a non-curing system, while that mainly composed of Components A+B+C+D is preferably used in a curing system.

As a matter of course, it is apparent that a lubricant such as stearic acid, stearic acid amide or phosphoric acid ester, an antioxidant, a coloring matter such as pigment and dye, etc. may be added as a processability-improving agent, if necessary.

Next, as the acrylic base pressure sensitive adhesive, a acrylic monomer alone such as ethylacrylate, butylacrylate, 2-ethylhexyl-acrylate, acrylate, acid or a copolymer thereof may be used, copolymers between these acrylic monomers with a methacrylate monomer such as methacrylic acid, methyl methacrylate, lauryl methacrylate, 2-hydroxyethyl-methacrylate. When used in a cured state, a polyfunctional polyisocyanate compound may be generally used.

Among the above-mentioned rubber base and acrylic base pressure sensitive adhesive compositions, a composition having its adhesion of not less than 0.04 kg/cm with respect to a cleaned surface of SUS 304 according to an adhesion measuring method specified in JIS Z-0237 (1980) may be favorably used.

Mentioning briefly the method of measuring the adhesion, a laminate in which an adhesive formulated according to a specified way is coated in a thickness of 0.3 mm onto a polyester film of 50 μm is sticked, as a sample, to a SUS 304 (25 mmϕ, 200 mm in length) cleaned with acetone by a given method, 180° peel test is repeated three times at a speed of 300 mm/min, and an adhesive force is determined by reducing the average value to a value per cm.

As the ferromagnetic materials to be compounded into these pressure sensitive adhesive compositions, use may be ordinarily made of powdery one. A hard magnetic material or a soft magnetic material may be employed.

Specifically, use may be made of ferrite magnet powder, cobalt magnet powder, aluni or alunico magnet powder, rare earth cobalt powder or soft ferrite powder, permalloy powder or the like.

Although depending upon the kind of the pressure sensitive adhesive composition, these ferromagnetic materials may be ordinarily compounded into 100 parts of a pressure sensitive adhesive composition in a range of 50–1,300 parts by weight, preferably 100–1,000 parts by weight.

The compounding may be carried out by adding the ferromagnetic material powder to the pressure sensitive adhesive composition little by little by using an ordinary kneading apparatus such as rolls or a kneader.

After the thus compounded material is molded into a sheet-like shape by using a processing machine of a press or extrusion type, the molding is magnetized by means of a condenser type magnetizing power source using a magnetizing yoke to obtain a sheet-like magnet, which is to be used as a rear surface layer.

Other method than the above, such as a method in which a magnetic pressure sensitive adhesive is directly coated onto the front surface layer of a hard coat treated polyester film in a sheet-like fashion, and magnetized to form a rear surface layer may be used.

The sheet-like magnet composed of the pressure sensitive adhesive composition containing the ferromagnetic material is illustrate based on a specific example. In the use of the rubber base pressure sensitive adhesive composition:

| | |
|---|---|
| Conjugated diene butyl rubber (manufactured by Exxon Chemical Co.) | 100 parts by weight |
| Polybutene (manufactured by Idemitsu Petrochemical Co. 2000 H) | 200 parts by weight |
| Silica (manufactured by Nippon Silica Co. Nipsil VN-3) | 40 parts by weight |
| 2,6-di-tert-butyl-p-cresol | 1 part by weight |

500 parts by weight of barium ferrite base magnetic powder (manufactured by Nippon Bengara Co.) was added to 100 parts by weight of a pressure sensitive adhesive composition (the adhesion of this adhesive composition was 0.08 kg/cm) obtained by kneading the above formulation with rolls, which was further kneaded by means of the rolls and then molded into a sheet of 1 mm in thickness by a press heated at 80° C. At that time, 50 μm of a polyester film was press fitted as a rear lining. This sheet was magnetized, and a bonded to an iron plate. Thereafter, a shear adhesion test and 90° peel test were carried out with respect to the iron plate. Results are shown in Table 1.

TABLE 1

| | Commercial rubber magnet | Example 1 |
|---|---|---|
| Adhesive strength under shear: g/cm$^2$ | 10 | 640 |
| 90° peeling: g/25 mm | 10 | 60 |

As compared with a commercial rubber magnet, the magnet using the pressure sensitive magnetic adhesive is equivalent or more with respect to 90° peeling value and far more excellent with respect to the adhesion under shear.

Although the peeling→reuse→re-peeling→testing was repeated twenty times, the adhesion under shear and 90° peeling value did not substantially change.

In the use of the acrylic base pressure sensitive adhesive composition, 700 parts by weight (mixing ratio 1:7) or 900 parts by weight (mixing ratio 1:9) of strontium base ferrite SOP-20 (manufactured by Nippon Bengara Co.) was kneaded into 100 parts by weight of a solution type acrylic base pressure sensitive adhesive (manufactured by Soken Kagaku Co.: only main ingredient of SK dyne 1102) in which a solvent had been removed (the adhesion of the pressure sensitive adhesive composition being not less than 0.96 kg/cm) by means of rolls, and 1 mm thickness of a sheet-like sample with a rear side lined with a polyester film was obtained. After it was magnetized by a magnetizing apparatus, a shear adhesion test and a 90° peel test were carried out. Results are shown in Table 2.

TABLE 2

| Mixing ratio of adhesive | 1:7 | 1:9 |
|---|---|---|

TABLE 2-continued

| | | |
|---|---|---|
| composition/ferromagnetic material | | |
| Adhesion under shear: g/cm$^2$ | 2,400 | 1,240 |
| 90° peeling: g/25 mm | 1,200 | 80 |

Although peeling→reuse→re-peeling→testing was repeated twenty times, adhesion under shear and 90° peeling value did not substantially change.

The white board according to the present invention may be a laminate in which a front surface layer of a hard coat treated and colored polyester film and a rear surface layer of a sheet-like magnet are directly laminated together or a laminate in which an intermediate layer made of a colored plastic film is laminated upon a front surface layer made of a transparent hard coat treated polyester film and a rear surface layer made of a sheet-like magnet is laminated thereonto.

As the material of the colored plastic film as the intermediate layer, any plastic material may be used so long as it may be adhered or stuck and is flexible.

The color of the colored polyester film or the colored plastic film is ordinarily white. But, any other color than white may be employed depending upon use, purpose and design.

In order to laminate and integrate these layers, any arbitrary adhesive or adhering agent may be used. The white board laminated by using a acrylic base or rubber base pressure sensitive adhesive is particularly preferable because the flexibility thereof is not damaged.

In this case, the double-sided pressure sensitive adhesive tape-like shape or sheet-like shape of an ordinarily available acrylic base or rubber base is preferably used. Although either one of the sheets having the unwoven cloth as a substrate or comprising only adhesive may be used, the sheet containing the unwoven cloth is preferably used when workability is taken into consideration.

When the magnetic pressure sensitive adhesive is used as the sheet-like magnet, a sheet obtained by processing the magnetic pressure sensitive adhesive according to the extrusion molding or press using the calender method or T-die method into a specific thickness may be directly bonded to the rear surface of the opposite layer.

Figure 2:
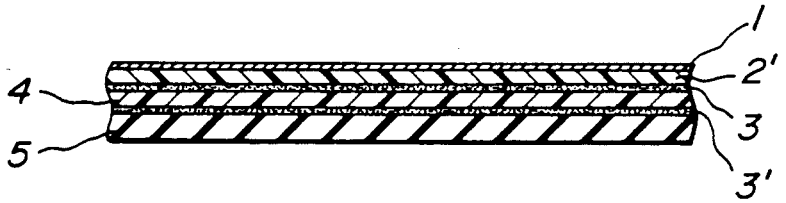
FIG. 2 is a partial side view of another embodiment of the white board according to the present invention in which a transparent polyester film having undergone a hard coat treatment is used as a front surface layer.

FIGS. 1 and 2 specifically show the constructions of the white boards according to the present invention. In FIG. 1, a hard coat treated polyester film constituting a front surface layer is colored. A rear surface layer of a sheet-like magnet 5 is laminated to the front surface layer of a white polyester film 2 having a hard coat layer through an adhesive layer 3.

In FIG. 2, a hard coat treated polyester film constituting the front surface layer is transparent. A white-colored organic film 4 is laminated upon the transparent polyester film 2' having a hard coat film layer 1 through an adhesive layer 3 and a rear surface layer of a sheet-like magnet 5 is laminated thereupon through the adhesive layer 3'.

When the magnetic pressure sensitive adhesive is used as the sheet-like magnet, the adhesive layer for attaching the magnet may be omitted as mentioned above.

With respect to the magnetization of the magnetizable adhesive, such may be carried out prior to the lamination. Alternatively, the magnetization may be effected posterior to the lamination.

The white board according to the present invention in which the magnetic pressure sensitive adhesive is used as the sheet-like magnet is most favorably used for steel surfaces. Incidentally, since the white board has a light adhering property, the white board can be adhered to glass, decorative wood plate, coated aluminum plates only by pushing it by hand. Thus, the white board according to the present invention can be favorably used in the state that it is attached to the surface of a wall or furniture in homes or offices.

The white board according to the present invention will exhibit the following effects.

(1) The white board according to the present invention can be easily attached or detached with respect to the steel wall surface of steel office desks, shelves, cabinets, partition panels, electric refrigerator, gas ranges, ovens, etc.

(2) Since no nail or ordinary adhesive is necessary for attaching the white board, no mark is left after detaching.

(3) Since the white board using the magnetic pressure sensitive adhesive as the sheet-like magnet may be attached to the glass, decorative wood plate, coated aluminum plate, etc., it can be easily attached or detached.

(4) The white board is easily carried due to its light weight and can be stored in a rolled state when not in use.

(5) Since the existing wall surface or face of the furniture can be utilized for the attachment, installation space can be saved.

What is claimed is:

1. A white board comprising; a front surface layer composed of a colored polyester film having undergone a hard coat treatment to provide a hard coat layer and, a rear surface layer composed of a magnetic sheet comprising a magnet in which a magnetic pressure sensitive adhesive composed of a pressure sensitive adhesive composition containing a ferromagnetic material is formed in a sheet, wherein said hard coat treatment is a treatment by which a surface of said transparent polyester film is treated with a hard coat treating agent consisting essentially of polysiloxane.

2. A white board according to claim 1 wherein said hard coat treatment is a treatment by which a surface of said polyester film is treated with a hard coat treating agent.

3. A white board according to claim 1, wherein said magnetic sheet is so constructed as to be flexible.

4. A white board comprising; a front surface layer composed of a transparent polyester film having undergone a hard coat treatment to provide a hard coat layer and, a rear surface layer composed of a magnetic sheet comprising a magnet in which a magnetic pressure sensitive adhesive composed of a pressure sensitive adhesive composition containing a ferromagnetic material is formed in a sheet, the white board further comprising an intermediate layer composed of a colored plastic film disposed between the front surface layer and said rear surface layer, wherein said hard coat treatment is a treatment by which a surface of said transparent polyester film is treated with a hard coat treating agent consisting essentially of polysiloxane.

5. A white board according to claim 4, wherein said magnetic sheet is so constructed as to be flexible.

6. A white board comprising; a front surface layer composed of a transparent polyester film having undergone a hard coat treatment to provide a hard coat layer and, a rear surface layer composed of a magnetic sheet comprising a magnet in which a magnetic pressure sensitive adhesive composed of a pressure sensitive adhesive composition containing a ferromagnetic material is formed in a sheet, the white board further comprising an intermediate layer composed of a colored plastic film disposed between the front surface layer and said rear surface layer and, wherein said hard coat treatment consists of a treatment by which a surface of said polyester film is treated with polysiloxane.

7. A white board comprising; a front surface layer composed of a colored polyester film having undergone a hard coat treatment to provide a hard coat layer and, a rear surface layer composed of a magnetic sheet comprising a magnet in which a magnetic pressure sensitive adhesive composed of a pressure sensitive adhesive composition containing a ferromagnetic material is formed in a sheet, wherein said hard coat treatment consists of a treatment by which a surface of said polyester film is treated with polysiloxane.

* * * * *